US008381373B2

(12) United States Patent
Jung

(10) Patent No.: US 8,381,373 B2
(45) Date of Patent: Feb. 26, 2013

(54) HOUSING FOR A DUAL RELEASE TWIN BUCKLE ASSEMBLY

(75) Inventor: Marc Jung, Indian Shores, FL (US)

(73) Assignee: Conax Florida Corporation, St. Petersburg, FL (US)

( * ) Notice: Subject to any disclaimer, the term of this patent is extended or adjusted under 35 U.S.C. 154(b) by 422 days.

(21) Appl. No.: 12/546,890

(22) Filed: Aug. 25, 2009

(65) Prior Publication Data

US 2010/0146749 A1 Jun. 17, 2010

Related U.S. Application Data

(60) Provisional application No. 61/093,485, filed on Sep. 2, 2008, provisional application No. 61/091,886, filed on Aug. 26, 2008.

(51) Int. Cl.

| | |
|---|---|
| ***A44B 11/25*** | (2006.01) |
| ***A44B 11/26*** | (2006.01) |
| ***B60R 22/00*** | (2006.01) |
| *B60R 22/22* | (2006.01) |

(52) U.S. Cl. ..... 24/632; 24/630; 24/634; 24/639

(58) Field of Classification Search ..... 24/579.09, 24/579.11, 593.1, 628, 629–632, 636–642, 24/646, 647, 655, 656, 697.1, DIG. 46–48, 24/DIG. 51, 311

See application file for complete search history.

(56) References Cited

U.S. PATENT DOCUMENTS

| | | | | |
|---|---|---|---|---|
| 2,846,745 | A * | 8/1958 | Lathrop | 24/179 |
| 2,893,088 | A * | 7/1959 | Harper et al. | 24/638 |
| 2,964,815 | A * | 12/1960 | Sereno | 24/323 |
| 3,029,487 | A * | 4/1962 | Asai | 24/638 |
| 3,091,010 | A * | 5/1963 | Davis | 24/646 |
| 3,104,440 | A * | 9/1963 | Davis | 24/646 |
| 3,110,071 | A * | 11/1963 | Higuchi | 24/646 |
| 3,137,907 | A * | 6/1964 | Unai | 24/646 |
| 3,142,103 | A * | 7/1964 | Lindblad | 24/638 |
| 3,145,442 | A * | 8/1964 | Brown | 24/639 |
| 3,165,805 | A * | 1/1965 | Lower | 24/646 |
| 3,233,941 | A * | 2/1966 | Selzer | 297/483 |
| 3,695,696 | A * | 10/1972 | Lohr et al. | 297/452.14 |
| 4,569,535 | A | 2/1986 | Haglund et al. | |
| 4,733,444 | A | 3/1988 | Takada | |
| 5,123,147 | A * | 6/1992 | Blair | 24/636 |
| 7,263,750 | B2 * | 9/2007 | Keene et al. | 24/638 |
| 2006/0277727 | A1 | 12/2006 | Keene et al. | |

FOREIGN PATENT DOCUMENTS

| | | |
|---|---|---|
| GB | 888436 | 1/1962 |
| GB | 1371151 | 10/1974 |

OTHER PUBLICATIONS

Arnett, Stephen E., Perkins Coie, Letter regarding U.S. Appl. No. 12/786,960 Assigned to Conax Florida Corporation, dated Jan. 5, 2012, including attachments: Source Control Drawing dated Oct. 25, 2006, and cited patents and patent publications.

(Continued)

*Primary Examiner* — Robert J Sandy
*Assistant Examiner* — Abigail E Morrell
(74) *Attorney, Agent, or Firm* — GrayRobinson, P.A.; Michael J. Colitz, III

(57) ABSTRACT

A housing assembly for twin latching mechanisms. The housing assembly includes two handles that can be pivoted to separately unlatch two belt connectors. The latching mechanisms are positioned within the housing such that when the handles are pivoted upwardly, their leading edges engage plunger mechanisms associated with the latching mechanisms. By engaging the plunger mechanisms, individual latches are disengaged and the associated belt connectors are ejected. A flange interconnects the two handles such that one or both handles are pivoted depending upon which handle is lifted by the operator. The housing provides a secure enclosure for the latch mechanisms and also shields the working components from the environment.

8 Claims, 8 Drawing Sheets

OTHER PUBLICATIONS

Arnett, Stephen E., Perkins Coie, Letter regarding U.S. Appl. No. 12/786,960 Assigned to Conax Florida Corporation, dated Mar. 20, 2012, including attachments: Drawing dated May 6, 2005, Quotation dated Jul. 13, 2005, Purchase Order dated Jul. 29, 2005, and Purchase Order faxed on Aug. 9, 2005.

* cited by examiner

HOUSING FOR A DUAL RELEASE TWIN BUCKLE ASSEMBLY

CROSS REFERENCE TO RELATED APPLICATIONS

This application claims priority to provisional application Ser. No. 61/093,485 filed on Sep. 2, 2008 and entitled "Housing for Dual Release Twin Buckle Assembly." This application also claims priority to provisional application Ser. No. 61/091,886 filed on Aug. 26, 2008 and entitled "Housing for Twin Latching Mechanism." The contents of both these applications are fully incorporated herein by reference.

FIELD OF THE INVENTION

This invention relates to a housing for a twin buckle assembly. More specifically, the present invention relates to a buckle assembly that accepts tongue plates from separate restraint belts and which permits the tongue plates to be separately released.

DESCRIPTION OF THE BACKGROUND ART

The use of restraint systems is now common place, and even mandatory, in a wide variety of vehicles. Aircraft, both fixed wing and rotary, and most types of land vehicles now all use restraints to prevent injury to vehicle occupants. Restraint systems are likewise used in watercraft. These restraint systems typically include lap and shoulder belts that are secured to a single tongue plate. The tongue plate, in turn, is releasably secured within a female receptacle of the buckle assembly.

This conventional design, however, is not acceptable in all situations. For instance, sometimes vehicle occupants are wearing heavy or bulky clothing. This situation may occur, for instance, when the occupants are firemen wearing fire retardant clothing, or soldiers wearing body armor. Other situations arise where the occupant may need to secure a shoulder belt without also securing the lap belt. In such cases, the use of conventional restraint systems is simply not possible. Namely, these situations require lap and shoulder belts that can be secured independently of one another.

An example of a buckle assembly with multiple belt connectors is disclosed in U.S. Pat. No. 7,263,750 to Keene. Keene discloses a buckle assembly for a vehicle restraint system where the buckle assembly is adapted to receive a plurality of belt connectors. The belt connectors are simultaneously released upon moving at least one handle to a release position.

Although the inventions of the prior art achieve particular objectives, these inventions also suffer from common drawbacks. These inventions, for instance, do not provide a housing that adequately protects the internal buckle assembly against damage and/or corrosion. Furthermore, the prior art inventions do not provide a device with separate housing and latching assemblies so as to improve durability and impact strength. The subject invention is directed at overcoming these shortcomings.

SUMMARY OF THE INVENTION

It is therefore one of the objectives of the present invention to provide a latching mechanism that is completely secured within a protective housing.

It is another objective of this invention to provide a device wherein the housing includes one or more pivotal upper handles that cooperate with one or more internal latching mechanisms.

It is yet another object of this invention to provide housing and latching mechanisms that are not fixedly interconnected so as to improve impact resistance.

It is still yet another objective of this invention to provide latching mechanisms with associated cover plates, wherein separate tongue plates can be independently secured and removed from the latching mechanisms.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a housing assembly for twin latching mechanisms. The housing assembly includes two handles that can be pivoted to separately unlatch two belt connectors. The latching mechanisms are positioned within the housing such that when the handles are pivoted upwardly, their leading edges engage plunger mechanisms associated with the latching mechanisms. By engaging the plunger mechanisms, individual latches are disengaged and the associated belt connectors are ejected. A flange interconnects the two handles such that one or both handles are pivoted depending upon which handle is lifted by the operator. The housing provides a secure enclosure for the latch mechanisms and also shields the working components from the environment.

Figure 1:
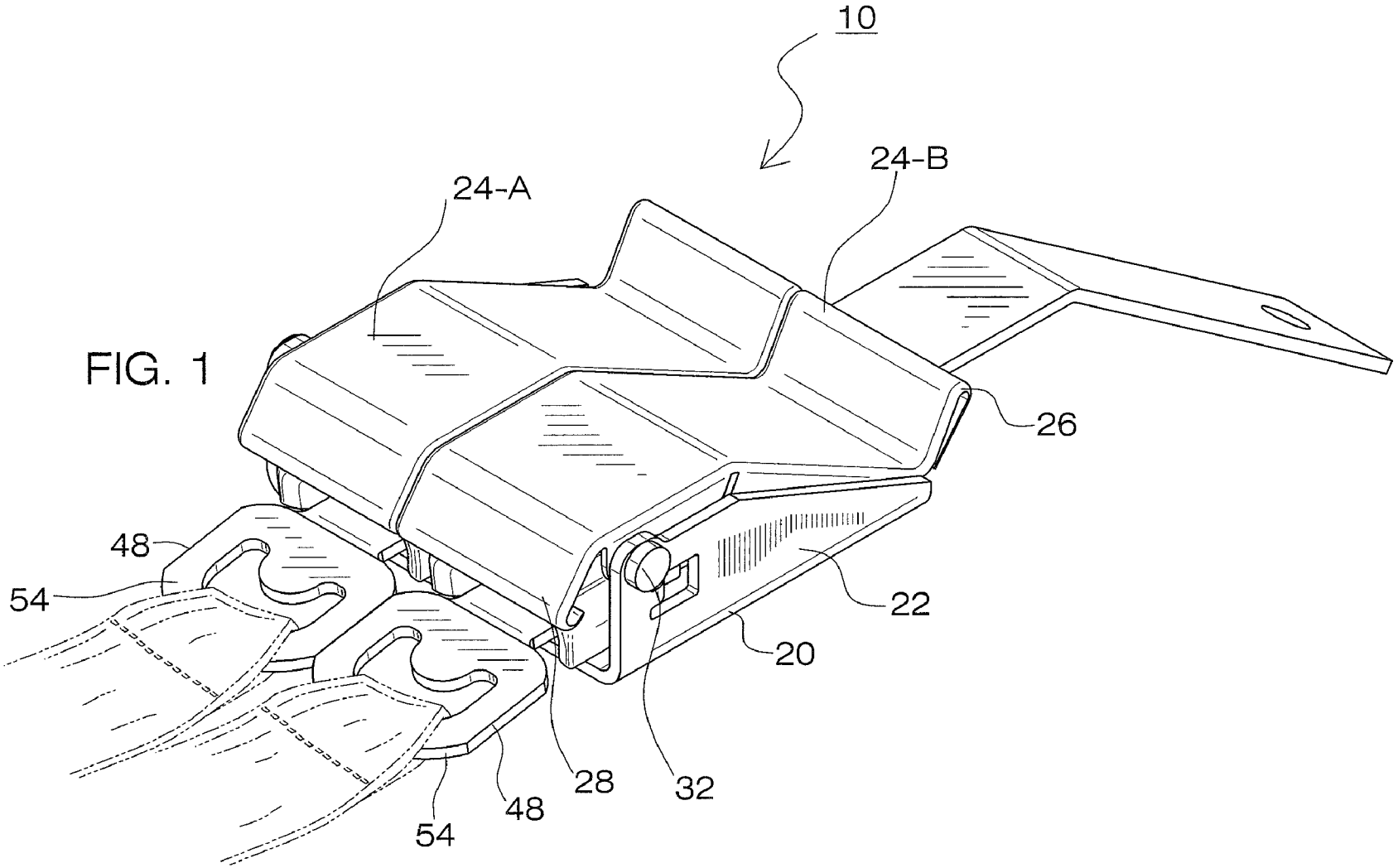
FIG. 1 is a perspective view of the housing assembly of the present invention in the closed, locked position, wherein both belt connectors are secured.

FIG. 1 is a perspective view of the housing assembly 10 in the closed orientation. This figure also illustrates the base 20 of the housing. Base 20 includes opposed upstanding side edges 22 which function in shielding the internal components of the latching mechanisms. In the particular embodiment depicted, side edges 22 are tapered downwardly towards the rearward end of base 20. Housing 10 further comprises two separate handles 24(*a*) and 24(*b*) that are pivotally secured to base 20. As illustrated in FIG. 1, each handle (24(*a*) and 24(*b*)) includes a rearward end with an upstanding lip 26. Lip 26 functions in giving a user a greater surface area with which to manipulate the individual handles (24(*a*) and 24(*b*)). This is preferred because many times an operator may be wearing gloves or other bulky protective garments. The forward end of each handle (24(*a*) and 24(*b*)) includes an inwardly rounded extent 28. Each extent 28 is adapted to engage an adjacent latching mechanism when the corresponding handle (24(*a*) and 24(*b*)) is pivoted, as noted more fully hereinafter. It will be further noted that the intermediate portion of each handle (24(*a*) and 24(*b*)) includes a downwardly angled extent that generally matches the slope of upstanding side edges 22. This configuration accommodates the internal components of the latching mechanisms while at the same time providing a generally closed configuration so as to prevent contaminants and/or debris from entering housing 10.

Figure 2:
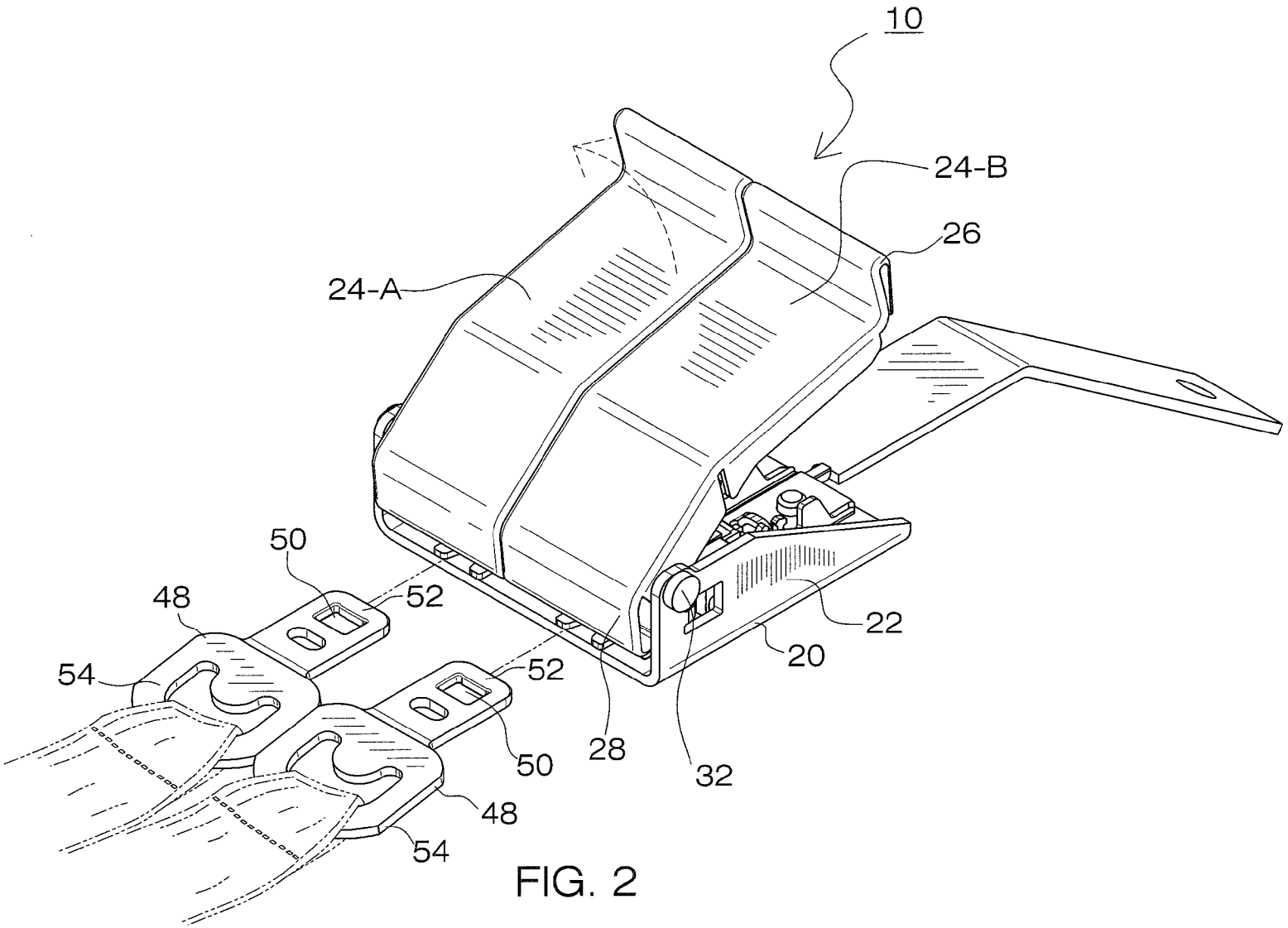
FIG. 2 is a perspective view of the housing in the opened position with both belt connectors ejected.
Figure 3:
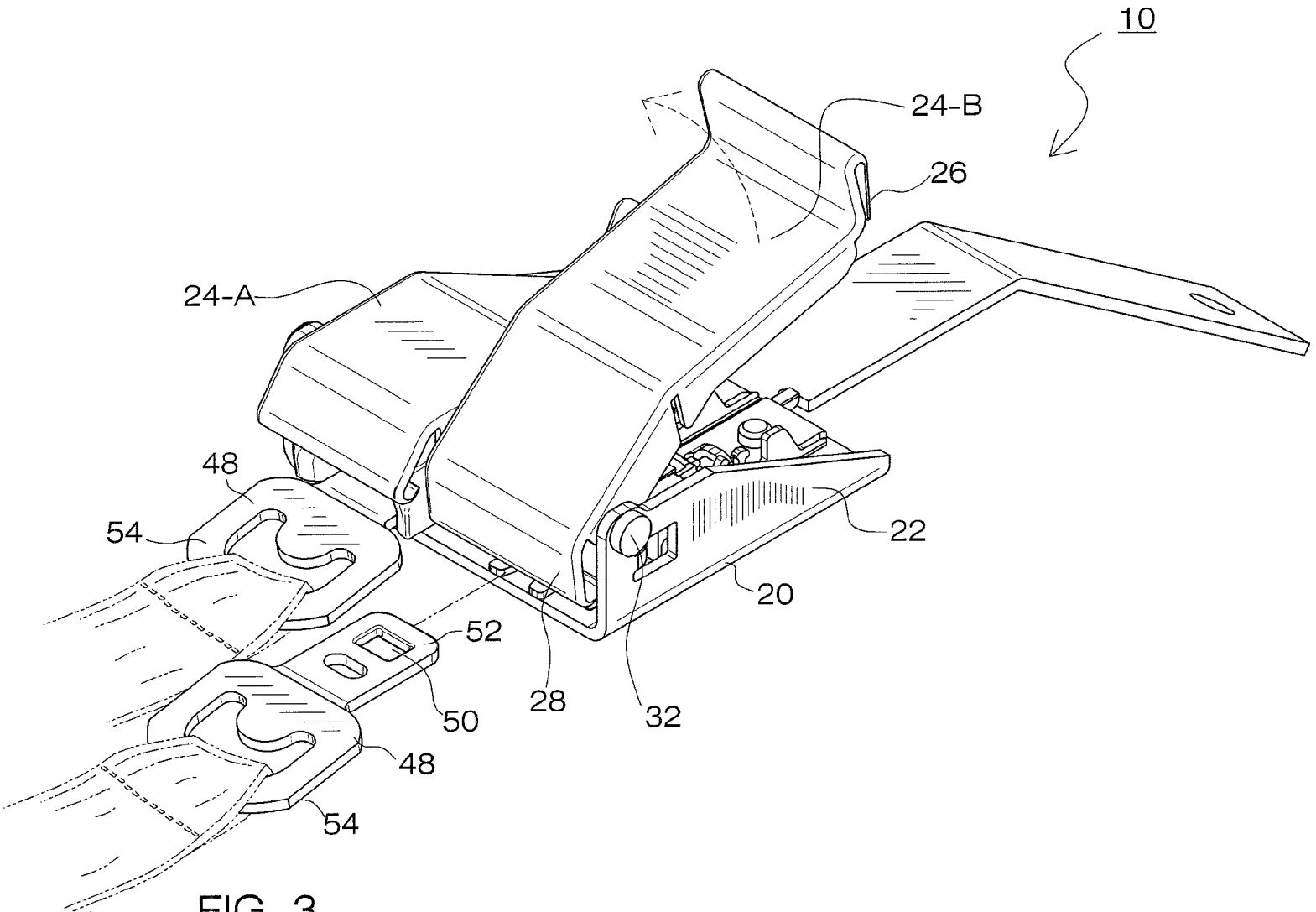
FIG. 3 is a perspective view of the housing in the partially opened position with one of the belt connectors ejected.
Figure 6:
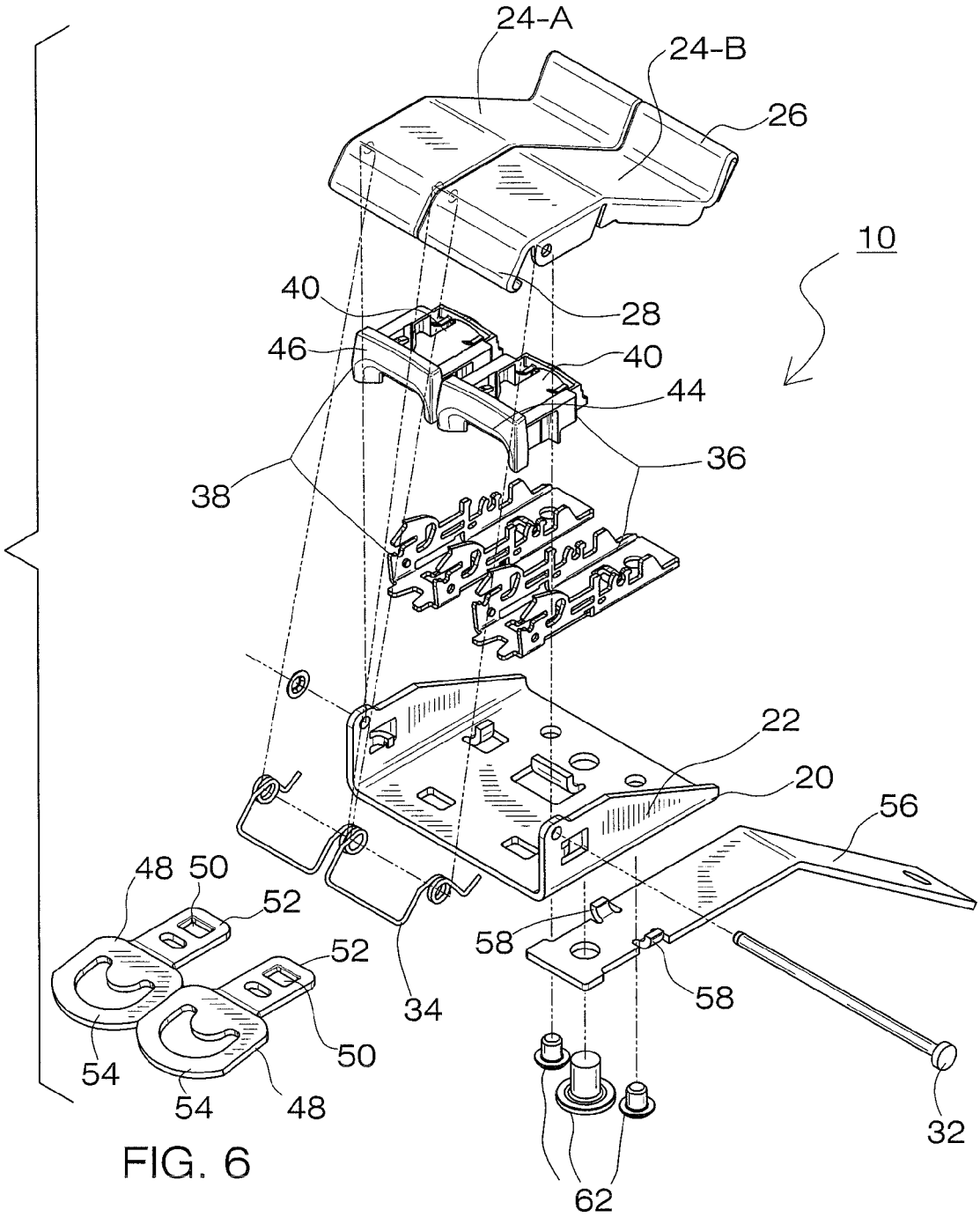
FIG. 6 is a fully exploded view of the housing of the present invention.

As depicted, handles (24(*a*) and 24(*b*)) are pivotally interconnected to base 20. In this regard, apertures are included within the side edges 22 of base 20 at the forward extent of housing 10. These apertures are dimensioned to receive a pivot pin 32 which is long enough to span the width of housing. A dual torsion spring 34 is mounted along the length of pivot pin 32 (note FIG. 6). Spring 34 includes an intermediate extent that is secured within the latching mechanism and distal ends that contact the inner surface of handles (24(*a*) and 24(*b*)). Spring 34, thereby, functions in separately biasing each handle (24(*a*) and 24(*b*)) into a closed position (as noted in FIG. 1). Conversely, when either handle (24(*a*) or 24(*b*)) is pivoted relative to base 20, as depicted in FIGS. 2 and 3, the operator must exert a sufficient amount of force to overcome the bias provided by spring 34.

Figure 4:
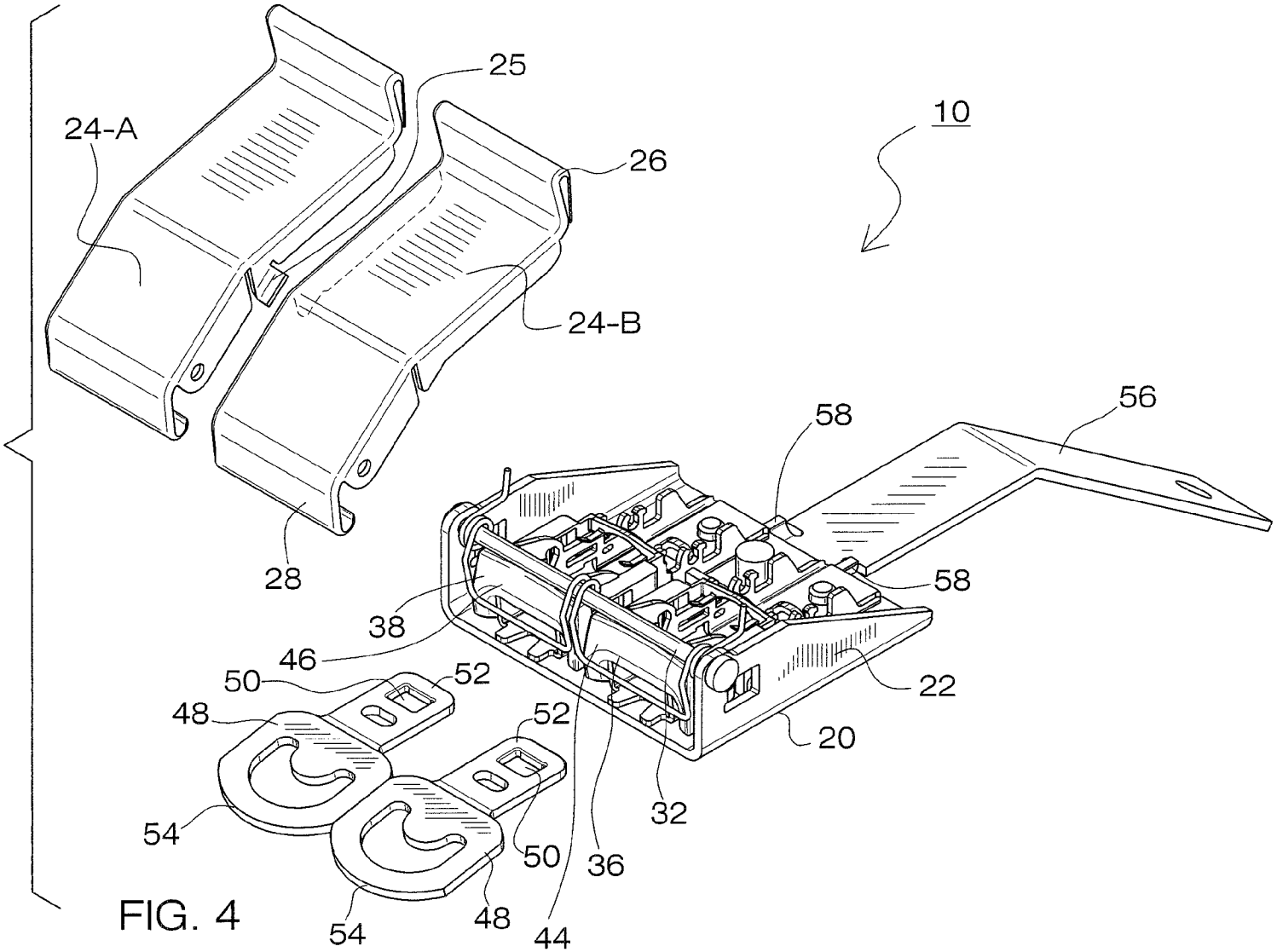
FIG. 4 is a partially exploded view of the housing of the present invention.
Figure 5:
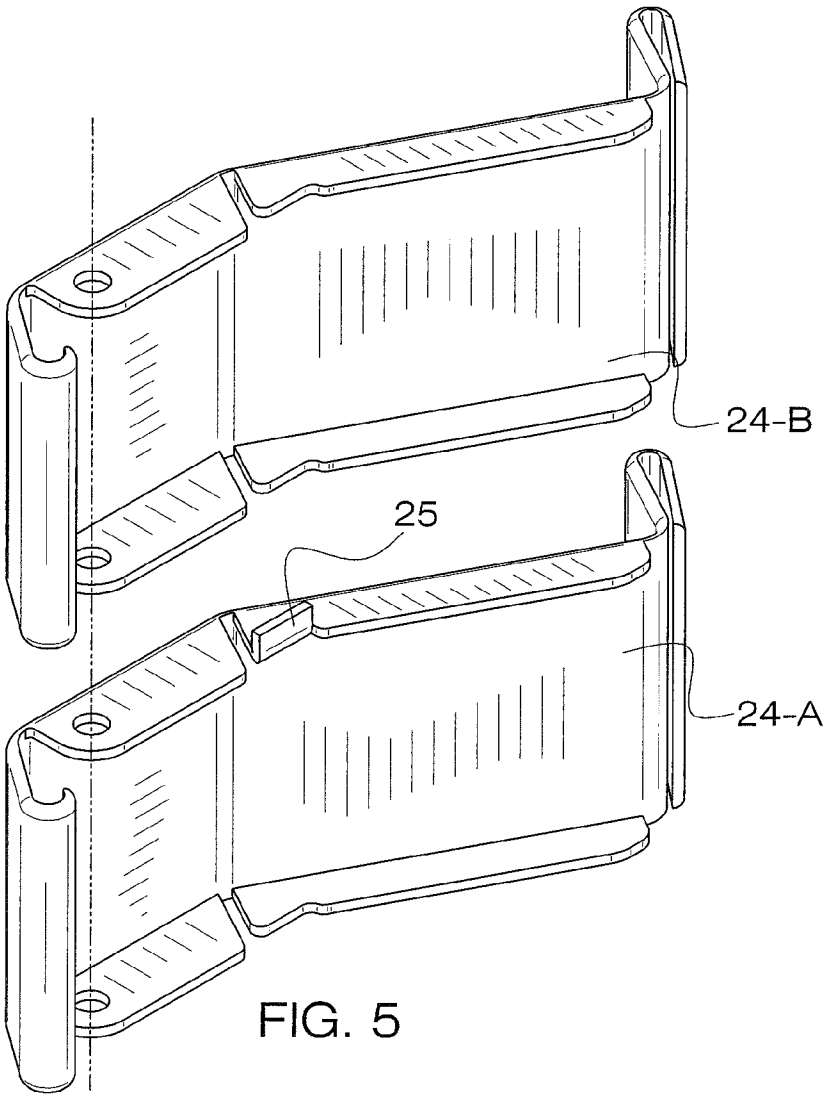
FIG. 5 is a detailed view of the two lifting handles of the present invention.

With reference now to FIG. 4, the internal latching mechanisms (36 and 38, respectively) of housing assembly 10 are depicted. In the preferred embodiment, two laterally disposed latching mechanisms (36 and 38) are included. However, it is within the scope of the present invention to utilize any other number of latching mechanisms. The preferred latching mechanisms are commercially available. Each of the mechanisms includes a lower extent that is adapted to be mounted to base 20 by way of rivets, screws, or similar fastening mechanisms.

Each latching mechanism (36 and 38) further includes an elongated male latch element 40 that is adapted to engage a corresponding aperture 50 within the belt connector 48. In the preferred embodiment, each latch element 40 is adapted to engage the associated belt connector 48 only when the forward tongue end 52 of the belt connector 48 is fully engaged into the respective latching mechanism (36 or 38). The latching elements can thereafter be disengaged by way of a plunger (44 and 46) that is associated with each latching mechanism (36 and 38). Each plunger (44, 46) is at the forward facing portion of the associated latching mechanism (36 and 38) and serves to disengage a belt connector 48 when depressed. Each of the belt connectors 48 further includes a rearward belt opening 54 by which a respective lap and/or shoulder belt can be secured.

In use, with the handle in its closed configuration, as depicted in FIG. 1, a user can insert the forward tongue end 52 of a belt connector 48 into either of the two respective latching mechanisms (36 or 38). Only when the belt connector 48 is fully inserted will the corresponding latching element 40 be forced downwardly (via a spring bias) so as to be inserted through the female opening 50 within tongue 52. In this orientation, the belt connector 48 is locked within the latching mechanism (36, 38).

The two latching mechanisms (36 and 38) are independently operable such that a user can selectively secure one or both of the belt connectors 48 as needed. Thereafter, when a user wishes to disengage the belt connectors 48, they can do so by pivoting one or both of the handles (24(*a*) and 24(*b*)) relative to base 20. In the preferred embodiment, handle 24(*b*) is separately operable while handle 24(*a*) operates in conjunction with handle 24(*b*). More specifically, as noted in FIG. 4, a connecting flange 25 is included on handle 24(*a*). By way of flange 25, when a user lifts handle 24(*a*), handle 24(*b*) is also lifted (note FIG. 2). However, handle 24(*b*) can be lifted without engaging flange 25 (note FIG. 3). Accordingly, handle 24(*b*) can be pivoted without pivoting handle 24(*a*).

In use, when handle 24(*a*) is pivoted, both handles 24(*a*) and 24(*b*) are lifted upwardly which, in turn, causes the rounded edges 28 of both handles 24(*a*) and 24(*b*) to simultaneously engage both of the plunger mechanisms (44 and 46) of the associated latching mechanisms (36 and 38). This causes both plunger mechanisms to be depressed inwardly, which causes each of the latching elements to disengage the tongue end 52 of the respective belt connector 48. Namely, the latching elements are caused to be removed from the female apertures of tongue elements 52. Each of the latching mechanisms (36, 38) further includes an ejector spring which causes the belt connector 48 to be forcibly ejected from the latching mechanism (36, 38) when disengaged. Thus, the pivotal movement of handle 24(*a*) causes both of the belt connectors 48 to be immediately released and ejected. Thereafter, handles 24(*a*) and 24(*b*) are caused to return the closed orientation via the bias of spring 34. In this orientation, the latching mechanisms (36, 38) are again free to accept one or more belt connectors 48.

When the user wishes to disengage only one belt connector 48, he or she lifts handle 24(*b*) (note FIG. 3). As noted, by lifting handle 24(*b*), the operator does not engage flange 25, such that only handle 24(*b*) is pivoted. As a result, only the rounded leading edge of handle 24(*b*) engages plunger 44. This, in turn, causes the corresponding belt connector to be ejected from only one latching mechanism 36. All of this is accomplished while the opposing belt connector 48 remains locked within latching mechanism.

In one possible arrangement, the belt connector associated with handle 24(*b*) is coupled to a shoulder belt. Likewise, the belt connector 48 associated with handle 24(*a*) is coupled to a lap belt. This arrangement would permit a user to release his or her shoulder belt without simultaneously releasing the lap belt by pivoting handle 24(*b*). Conversely, by pivoting handle 24(*a*), both the lap and shoulder belts would be released. Of course, other restraint arrangements are within the scope of the present invention.

Figure 7:
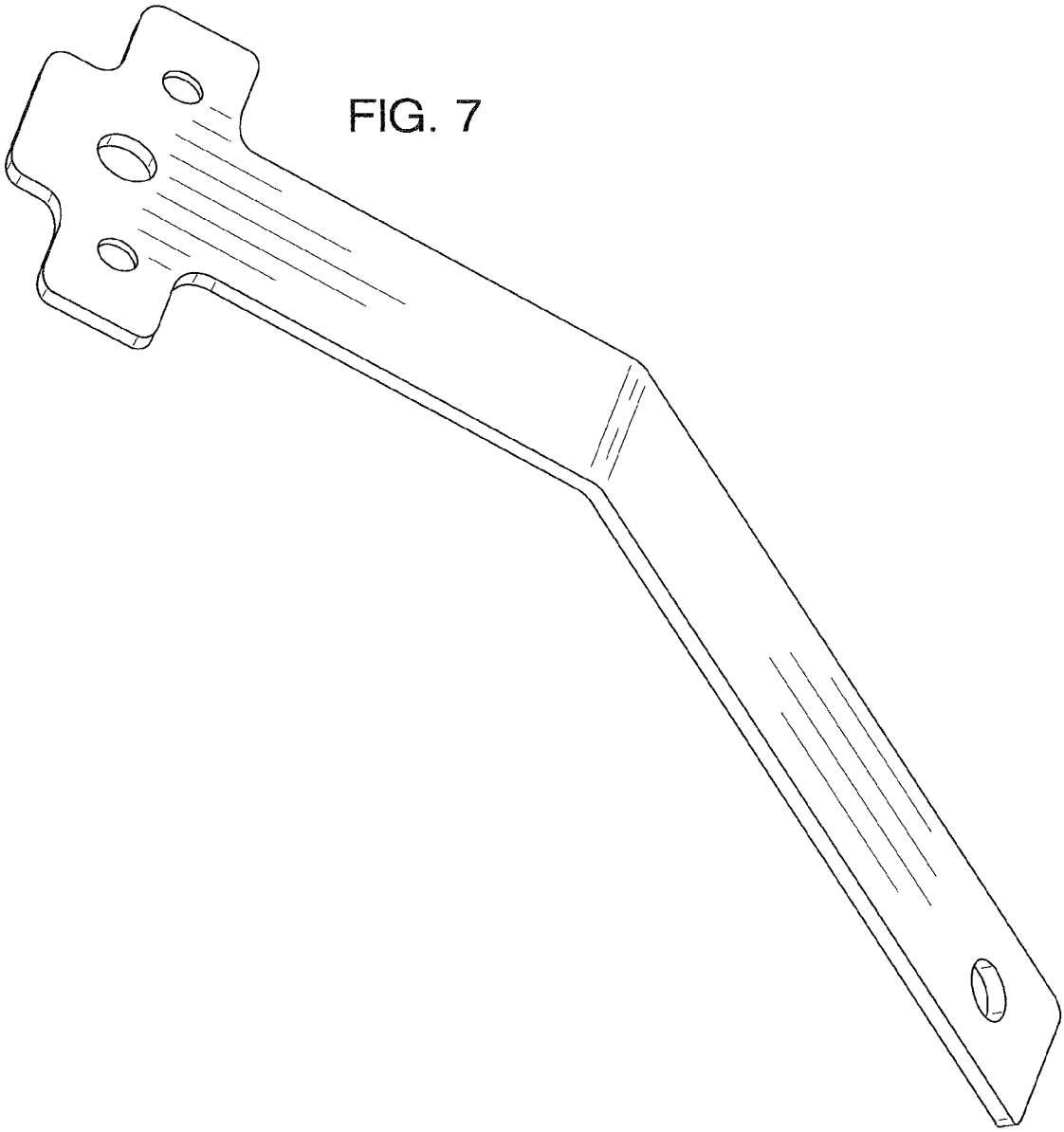
FIG. 7 is a detailed view of a T-shaped mounting bracket for use in the assembly of the present invention.
Figure 8:
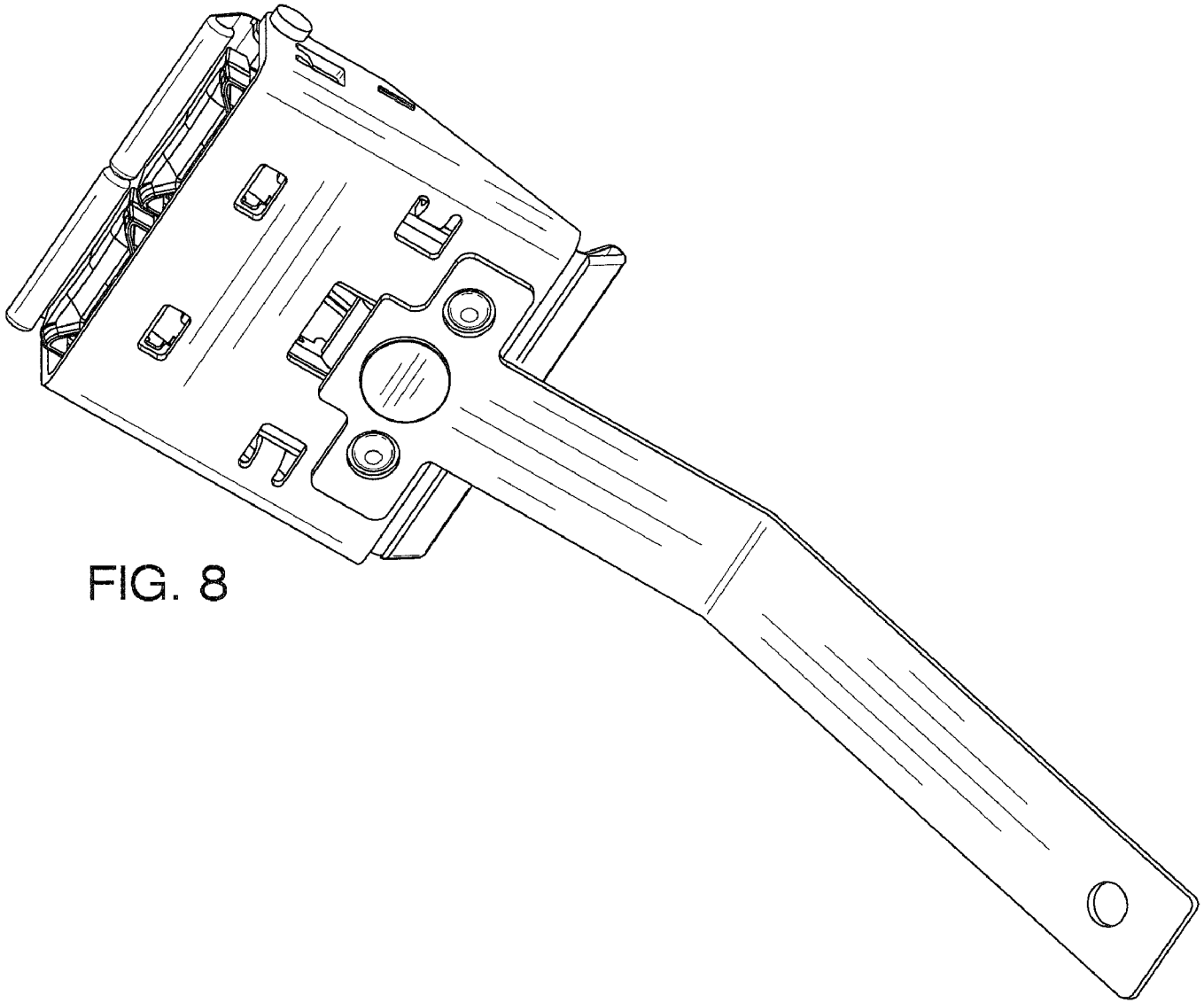
FIG. 8 is a detailed view of a T-shaped mounting bracket for use in the assembly of the present invention.

Housing assembly 10 is secured to the interior of a vehicle by way of a mounting bracket 56 (note FIG. 4). Namely, mounting bracket 56 includes a first end which can be secured to the frame of the vehicle via a rivet or bolt (note FIG. 6). Mounting bracket 56 is preferably angled so as to insure the proper orientation of housing assembly relative to the user. The opposite end of mounting bracket 56 includes a mounting aperture for use in securing the housing assembly to the mounting bracket. This interconnection can again be achieved by way of rivets and/or similar fasteners 62. Importantly, this end of the mounting bracket 56 includes two upwardly standing anti-rotation fins 58 (note FIG. 6). These fins 58 abut the rearward edge of the base 20 and, thereby, prevent base 20 from pivoting relative to mounting bracket 56 or otherwise getting positioned into an orientation that is not conducive to the latching or unlatching of the belt connectors 48. In an alternative embodiment, mounting bracket 56 can have a T-shaped end with associated mounting apertures to prevent rotation (FIGS. 7 and 8).

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A vehicle restraint system (10) having twin buckles and a dual release assembly, the restraint system (10) comprising:

a lower base (20) having angled and upstanding side edges (22), a mounting bracket (56) having a first end secured to the lower base (20) and a second end secured to the vehicle, the mounting bracket (56) including anti-rotation fins (58) at the first end, the anti-rotation fins (58) preventing relative movement between the lower base (20) and the mounting bracket (56);

a pair of passenger restraint belts, each belt including a distal end with a tongue (48) and an aperture (50);

first and second laterally disposed, separate, and independently operable latching mechanisms (36 and 38) secured within the lower base (20), each latching mechanism including a male latching element (40) and a forward facing plunger (44 and 46), each latching mechanism (36 and 38) having an engaged orientation wherein the male latching element (40) is positioned within the aperture (50) of an associated tongue (48) to secure one of the restraint belts, each latching element (36 and 38) further including a disengaged orientation that is activated by depressing an associated plunger (44 and 46), wherein in the disengaged orientation the male latching element (40) is released from the aperture (50)

a first handle (24(*a*)) having a rearward end with an upstanding lip (26), a forward end with a rounded extent (28), and a connecting flange (25), the first handle (24(*a*)) being pivotally secured to the lower base (20) via a torsion spring (34), the spring (34) functioning to urge the first handle (24(*a*)) to a closed orientation relative to the base (20), the first handle (24(*a*)) having a pivoted orientation wherein the rounded extent (28) of the handle depresses an associated forward facing plunger (44 or 46) of an associated latching mechanism (36 or 38) to thereby release the associated tongue (48);

a second handle (24(*b*)) having a rearward end with an upstanding lip (26) and a forward end with a rounded extent (28), the second handle (24(*b*)) being pivotally secured to the lower base (20) via a torsion spring (34), the spring (34) functioning to urge the second handle (24(*b*)) to a closed orientation relative to the base (20), the second handle 124(b)) having a pivoted orientation wherein the rounded extent (28) of the handle depresses an associated forward facing plunger (44 or 46) of an associated latching mechanism (36 or 38) to thereby release the associated tongue (48);

whereby the connecting flange (25) interconnects the first and second handles (24(*a*) and 24(*b*)) such that the first handle (24(*a*)) pivots along with the second handle (24(*b*) but the second handle (24(*b*)) pivots by itself.

2. A protective housing for a female component of a vehicle restraint system, the female component including a plurality of laterally disposed and separate latching mechanisms (36 and 38), each latching mechanism (36 and 38) including a male latching element (40) and a forward facing plunger (44 or 46), wherein in an engaged orientation a tongue (48) of a restraint belt is releasably secured an associated latching mechanism (36 and 38) via the male latching element (40), and in a disengaged orientation the male latching element (40) is released by depressing an associated plunger (44 or 46), such that the tongue can be removed, the protective housing comprising:

a lower base (20) having a forward end and a rearward end and upstanding side edges (22), the lower base (20) being secured to the vehicle, the plurality of latching mechanisms (36 and 38) being secured within the lower base (20);

a pair of handles (24(*a*) and 24(*b*)), each handle (24(*a*) and 24(*b*)) having a rearward end with an upstanding lip (26) and a forward end with a rounded extent (28), the forward end of each handle being pivotally secured to the forward end of the lower base (20), whereby when the handles (24(*a*) and 24(*b*)) are in a closed orientation debris is prevented from entering the plurality of latching mechanisms (36 and 38), and whereby when the handles (24(*a*) and 24(*b*)) are in a pivoted orientation the rounded extent (28) of each handle engages the forward facing plungers (44 or 46) of the plurality of latching mechanisms (36 and 38) to thereby release the associated tongues (48); and a connecting flange (25) interconnecting the first and second handles (24(*a*) and 24(*b*)) such that the first handle (24(*a*)) pivots along with the second handle (24(*b*)) but second handle (24(*b*)) pivots independently of the first handle (24(*a*)).

3. The protective housing as described in claim 2 further comprising a mounting bracket (56) having a first end secured to the lower base (20) and a second end secured to the vehicle, the mounting bracket including anti-rotation fins at the first end, the anti-rotation fins (58) preventing relative movement between the base (20) and the mounting bracket (56).

4. The protective housing as described in claim 2 wherein both the handles (24(*a*) and 24(*b*)) and the lower housing (20) have matched angled extents such that in the closed orientation the latching mechanisms (36 and 38) are fully enclosed.

5. The protective housing as described in claim 2 wherein two latching mechanisms (36 and 38) are included and further wherein the rounded extent (28) of the handles independently engage both associated plungers (44 or 46) in the pivoted orientation.

6. The protective housing as described in claim 2 wherein the upstanding lip (26) of each handle is sufficiently large to permit manipulation of the handle by an operator wearing protective gloves.

7. The protective housing as described in claim 2 wherein a torsion spring (34) is used to pivotally connect the handles (24(*a*) and 24(*b*)) to the lower housing (20) and wherein the torsion (34) spring biases the handles (24(*a*) and 24(*b*)) to the closed orientation.

8. The protective housing as described in claim 2 wherein the disengaged orientation is achieved when the associated handle (24(*a*) and 24(*b*)) is pivoted at approximately 45 degrees relative to the lower base (20).

* * * * *

UNITED STATES PATENT AND TRADEMARK OFFICE

CERTIFICATE OF CORRECTION

PATENT NO. : 8,381,373 B2
APPLICATION NO. : 12/546890
DATED : February 26, 2013
INVENTOR(S) : Marc Jung It is certified that error appears in the above-identified patent and that said Letters Patent is hereby corrected as shown below:

In the Specifications:

Col. 4, line 46, the term "connector associated" should be "connector 48 associated".

Col. 4, line 58, the term "bolt (note FIG. 6)" should be "bolt 62 (note FIG. 6)".

Col. 4, line 60, the term "assembly relative" should be "assembly 10 relative".

In the Claims:

Col. 5, line 58, Claim 1, the term "handle 124(b))" should be "handle (24(b))".

Signed and Sealed this
Thirteenth Day of August, 2013

Teresa Stanek Rea
*Acting Director of the United States Patent and Trademark Office*